US007261225B2

(12) United States Patent
Rueschhoff et al.

(10) Patent No.: US 7,261,225 B2
(45) Date of Patent: Aug. 28, 2007

(54) VALVE FOR AEROSOL CAN

(75) Inventors: Kenneth J. Rueschhoff, Wildwood, MO (US); James P. McBroom, House Springs, MO (US); Joseph C. Lott, Des Peres, MO (US)

(73) Assignee: Clayton Corporation, Fenton, MO (US)

( * ) Notice: Subject to any disclaimer, the term of this patent is extended or adjusted under 35 U.S.C. 154(b) by 0 days.

(21) Appl. No.: 11/242,597

(22) Filed: Oct. 3, 2005

(65) Prior Publication Data

US 2006/0076365 A1 Apr. 13, 2006

Related U.S. Application Data

(60) Provisional application No. 60/615,790, filed on Oct. 4, 2004.

(51) Int. Cl.
*B65D 83/00* (2006.01)

(52) U.S. Cl. ..... 222/402.25; 222/402.1; 222/402.24

(58) Field of Classification Search ..... 222/402.1, 222/402.24, 402.25, 518; 251/339
See application file for complete search history.

(56) References Cited

U.S. PATENT DOCUMENTS 3,521,859 A * 7/1970 Gronemeyer ..... 251/353
3,647,121 A * 3/1972 Ayres ..... 222/402.24
4,471,893 A * 9/1984 Knickerbocker ..... 222/402.22
4,852,807 A * 8/1989 Stoody ..... 239/337
5,014,887 A 5/1991 Kopp ..... 222/402.1
6,058,960 A 5/2000 Kopp ..... 137/68.11
6,371,338 B1 * 4/2002 Klein et al. ..... 222/402.1
6,817,494 B2 11/2004 Lilienthal ..... 222/402
2003/0071081 A1 * 4/2003 Lilienthal ..... 222/402.1
2003/0141322 A1 * 7/2003 Groeger ..... 222/402.1

* cited by examiner

*Primary Examiner*—Kevin Shaver
*Assistant Examiner*—Stephanie E. Tyler
(74) *Attorney, Agent, or Firm*—Harness, Dickey & Pierce, P.L.C.

(57) ABSTRACT

A valve assembly for an aerosol can comprises a valve conduit having an inlet, an outlet, a valve seat in the flow path between the inlet and the outlet, and a resilient mounting of a valve member that permits relative movement of the valve member relative to the valve conduit. The valve member further comprises a valve element that is movable to sealingly engaging the valve seat, and a stem projecting from the valve member through the outlet of the valve conduit. During the movement of the valve member relative to the valve conduit, the movable tapered sealing surface associated with the valve member is configured to engage and concentrically align with a tapered valve seat on the valve conduit to establish an effective seal against the valve seat.

34 Claims, 4 Drawing Sheets

VALVE FOR AEROSOL CAN

CROSS REFERENCE TO RELATED APPLICATIONS

This application claims the benefit of U.S. Provisional Application No. 60/615,790, filed Oct. 4, 2004, The disclosure of which is incorporated herein by reference.

FIELD OF THE INVENTION

BACKGROUND OF THE INVENTION

This invention relates to valves for aerosol cans, and in particular to improved aerosol valve with a reduced number of parts.

Aerosol containers which dispense products have found wide application, from dispensing insulating urethane foams to whipped cream. The products are often packaged in aerosol cans with a pressurizing agent, which acts as a propellant for dispensing a liquid product. These aerosol cans include a dispensing valve that may be employed in dispensing a foam-forming liquid as a foam. Such valves may be intermittently operated to dispense small amounts of the product as needed. However, these valves typically comprise numerous parts made from various materials that can make the valves difficult and expensive to assemble, and can present component and product degradation issues.

SUMMARY OF THE INVENTION

The present invention relates to a valve assembly for a container with a pressurizing agent that acts as a propellant for dispensing a liquid product. The valve assembly comprises a valve conduit having an inlet, an outlet, a valve seat in the flow path between the inlet and the outlet, and a resilient mounting of a valve member that permits relative movement of the valve member relative to the valve conduit. The valve member further comprises a valve element that is movable to sealingly engaging the valve seat, and a stem projecting from the valve member through the outlet of the valve conduit. The valve conduit is adapted to be retained within an opening in the container.

In one aspect of the present invention, a valve assembly is provided for an aerosol can in which the valve is biased to a closed position by a spring. The valve assembly comprises a tapered valve seat in the flow path between an inlet and outlet of a valve conduit, and a valve member mounted within the valve assembly in a manner that permits relative movement of a tapered sealing surface on the valve member relative to the valve conduit. The valve member further comprises one or more integrally formed springs extending radially from the valve member that are retained within a valve conduit in a manner such that the tapered sealing surface of the valve member is biased to sealingly engage the tapered valve seat, wherein the valve stem projecting from the valve member may be displaced to move the tapered sealing surface away from the valve seat to allow flow through the valve outlet. Such a valve having a valve conduit and movable valve member in accordance with the principles of the present invention comprises a minimum of moving parts that reduces cost, corrosion and manufacturing concerns.

In another aspect of the present invention, a valve assembly is provided for in which the movement of a valve member provides for alignment with a valve seat. During the movement of the valve member relative to the valve conduit, the movable tapered sealing surface associated with the valve member is configured to engage and concentrically align with a tapered valve seat on the valve conduit to establish an effective seal against the valve seat. The surfaces of the valve seat and valve member therefore provide improved alignment and seating to establish a reliable effective seal against each other. The valve assembly is particularly well-suited for use in an aerosol can, although the invention is not so limited.

These and other features and advantages of the invention will be more fully understood from the following detailed description of the invention taken together with the accompanying drawings.

BRIEF DESCRIPTION OF THE DRAWINGS

Corresponding reference numerals indicate corresponding parts throughout the several views of the drawings.

DETAILED DESCRIPTION OF THE INVENTION

Figure 1:
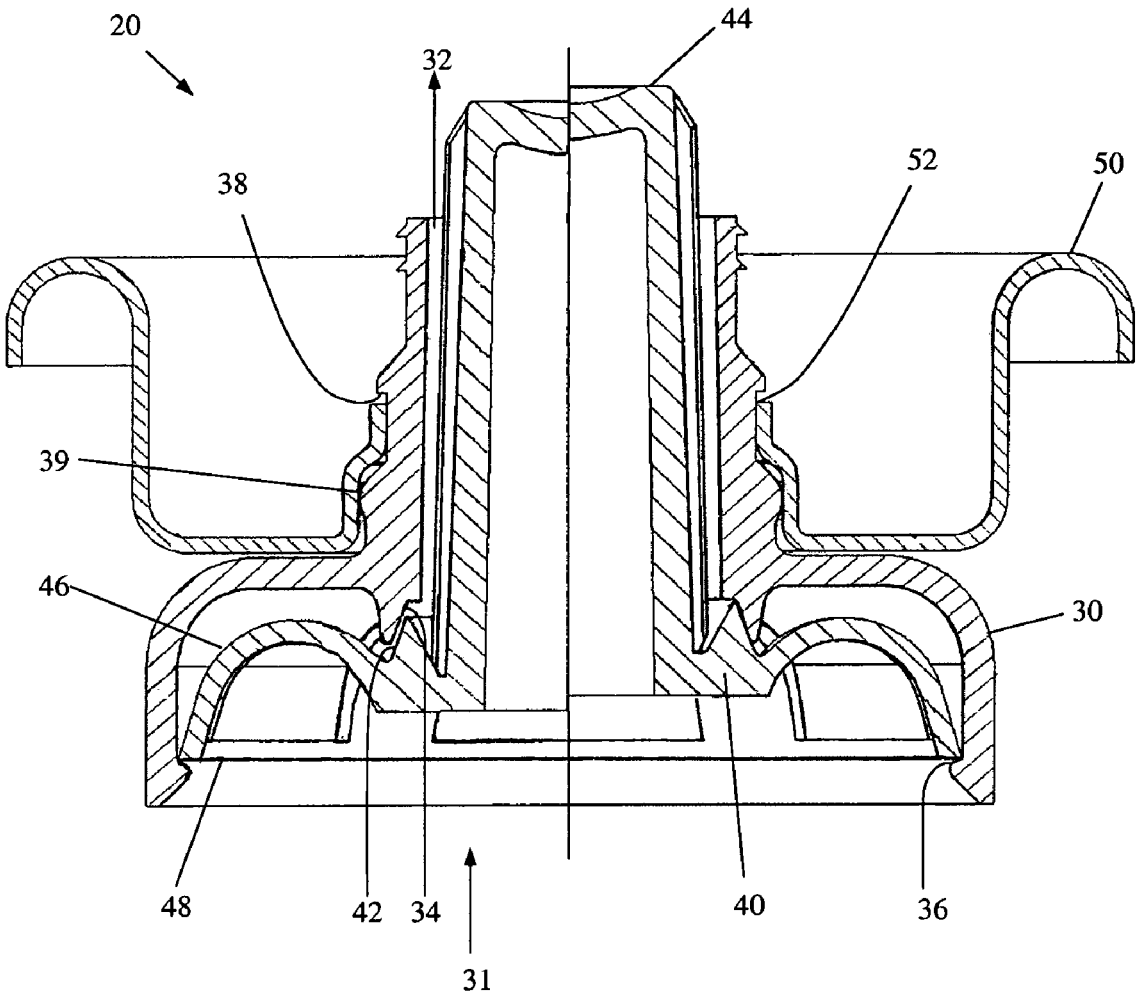
FIG. 1 is a section view of one embodiment of a valve assembly showing a valve member in a sealed and an open position in accordance with the principles of the present invention.

A dispensing valve assembly for an aerosol can in accordance with the principles of the present invention is indicated generally as 20 in FIG. 1. The valve assembly 20 comprises a valve conduit 30 having an inlet 31, an outlet 32, a valve seat 34 in the flow path between the inlet 31 and outlet 32, and a resilient mounting of a valve member 40 that permits relative movement of the valve member 40 relative to the valve conduit 30. The valve member 40 further comprises a valve element 42 that is movable to sealingly engage the valve seat 34, and a stem 44 projecting from the valve member through the outlet 32 of the valve conduit 30. The valve conduit 30 is adapted to be retained within an opening in a container with a pressurizing agent that acts as a propellant for dispensing a liquid product. The valve assembly 20 is particularly well-suited for use in an aerosol can, although the invention is not so limited.

The resilient mounting of the valve member 40 comprises one or more integrally formed springs 46 that extend radially outward from the valve member 40, the one or more springs 46 being retained within the valve conduit 30 in such a manner that the valve element 42 is biased against the valve seat 34. The springs 46 are similar to that of a leaf or ribbon spring, and are co-joined to an annular ring 48 at the base of the valve member 40. In one embodiment of the present invention, the valve member 40 comprises six integrally formed spring members 46, but may alternatively comprise any number of spring members that will provide an axial loading suitable for obtaining an effective sealing force. The sealing force provided by the one or more springs 46 is produced by the mounting of the valve member 40 within the valve conduit 30, where the valve conduit 30 comprises a retaining means for retaining the one or more integrally formed springs 46 in a loaded or compressed position. Specifically, the valve member 40 may be inserted into the inlet 31 of the valve conduit 30, and displaced to a compressed position in which the annular ring 48 of the valve member is retained in a loaded position by a retaining means 36. In one embodiment of the present invention, the retaining means 46 comprises a tapered annular ring 36 in the inlet of the valve conduit 30, where the valve member 40 slides along the tapered ring and snaps in place within the valve conduit. Once in place, the one or more springs 46 bias the sealing valve element 42 of the valve member 40 against the valve seat 34. The valve member 40 further comprises a stem 44 projecting from the valve member out through the outlet 32 of the valve conduit 30. Displacing the stem 44 and valve member 40 relative to the valve conduit 30 compresses the one or more springs 46 to move the valve element 42 away from the valve seat 34 to allow flow through the valve seat 34 and the outlet 32.

The valve member 40 is shown in FIG. 1 in an open position on the left half of the drawing, and in a sealed, closed position on the right half of the drawing. The valve element 42 comprises a generally tapered sealing surface that is disposed annularly around the valve element 40. The valve seat 34 comprises an opening inside the valve conduit 30 having a generally tapered surface. During the movement of the valve element 42, the valve element's tapered sealing surface engages and concentrically aligns with the tapered surface on the valve seat 34 to establish an effective seal against the valve seat 34. The surfaces of the valve seat and valve member therefore provide improved alignment and seating to establish a reliable effective seal against each other. Manufacturing tolerances that can cause the valve surface to be misaligned with the valve seat and result in a compromised seal are accordingly overcome by the self aligning feature of the valve in accordance with the present invention. The tapered sealing surface 42 is elongated to centering and alignment control of the moveable valve surface with respect to the tapered valve seat. Furthermore, the tapered sealing surface 42 on the valve member 40 is configured in a manner such that the valve member 40 may be molded without the presence of mold parting line on the tapered sealing surface. Likewise, the tapered valve seat surface 34 on the valve conduit 30 is configured in a manner such that the valve conduit 30 may be molded without the presence of a mold parting line on the valve seat surface 34. This allows the valve components to be molded with continuous, smooth sealing surfaces that will be free of mismatches and surface imperfections such as parting lines and flash. Thus, the valve according to the principles of the present invention provides for concentric alignment of a smooth valve surface with a smooth valve seat surface to establish an effective reliable seal between the valve member and the valve seat.

Figure 2:
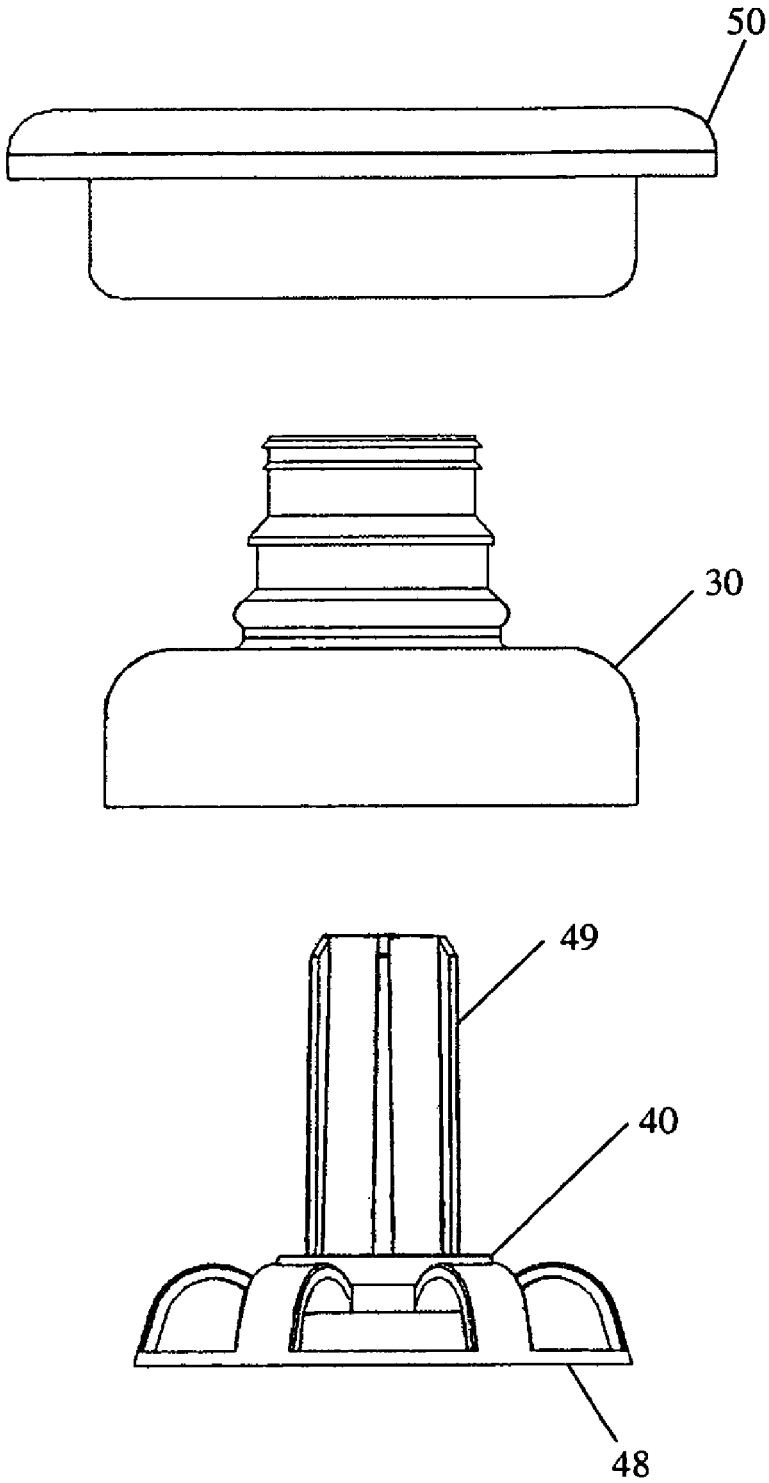
FIG. 2 is a is an exploded assembly view of a valve assembly.
Figure 3:
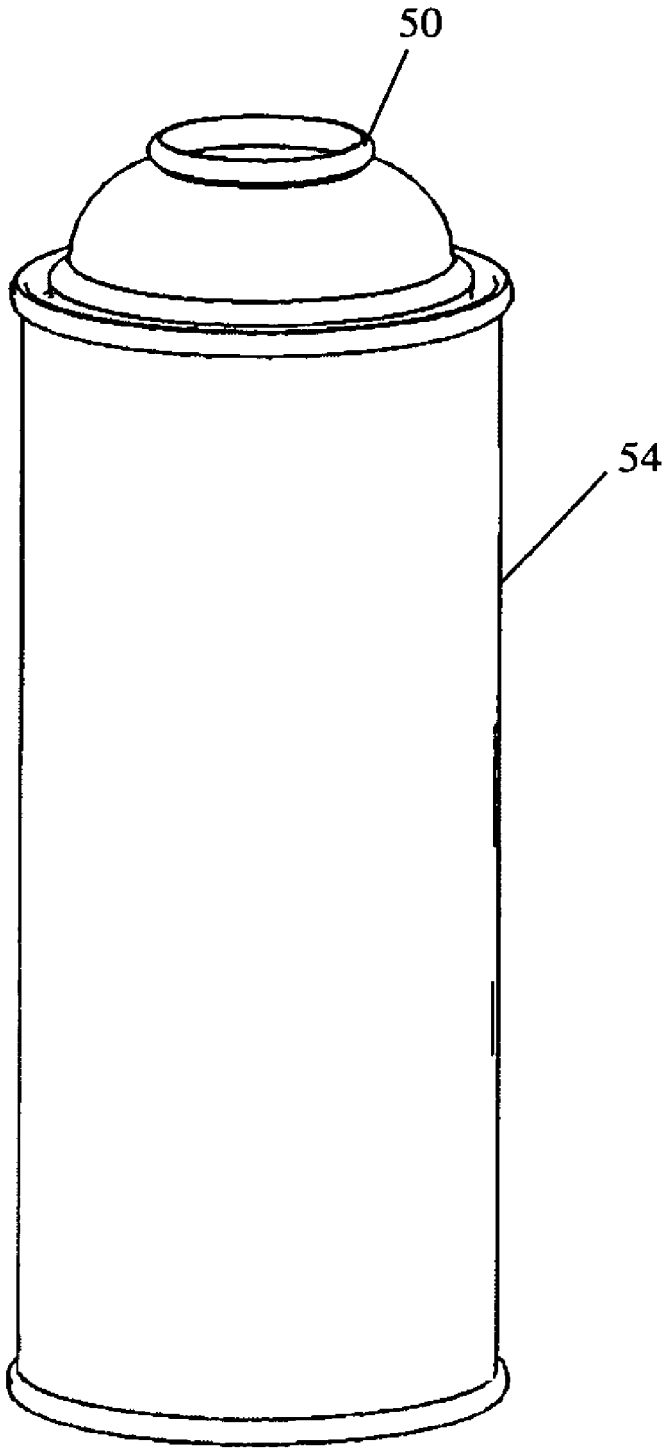
FIG. 3 is a side elevation view of an aerosol can with a cup secure to the can.
Figure 4:
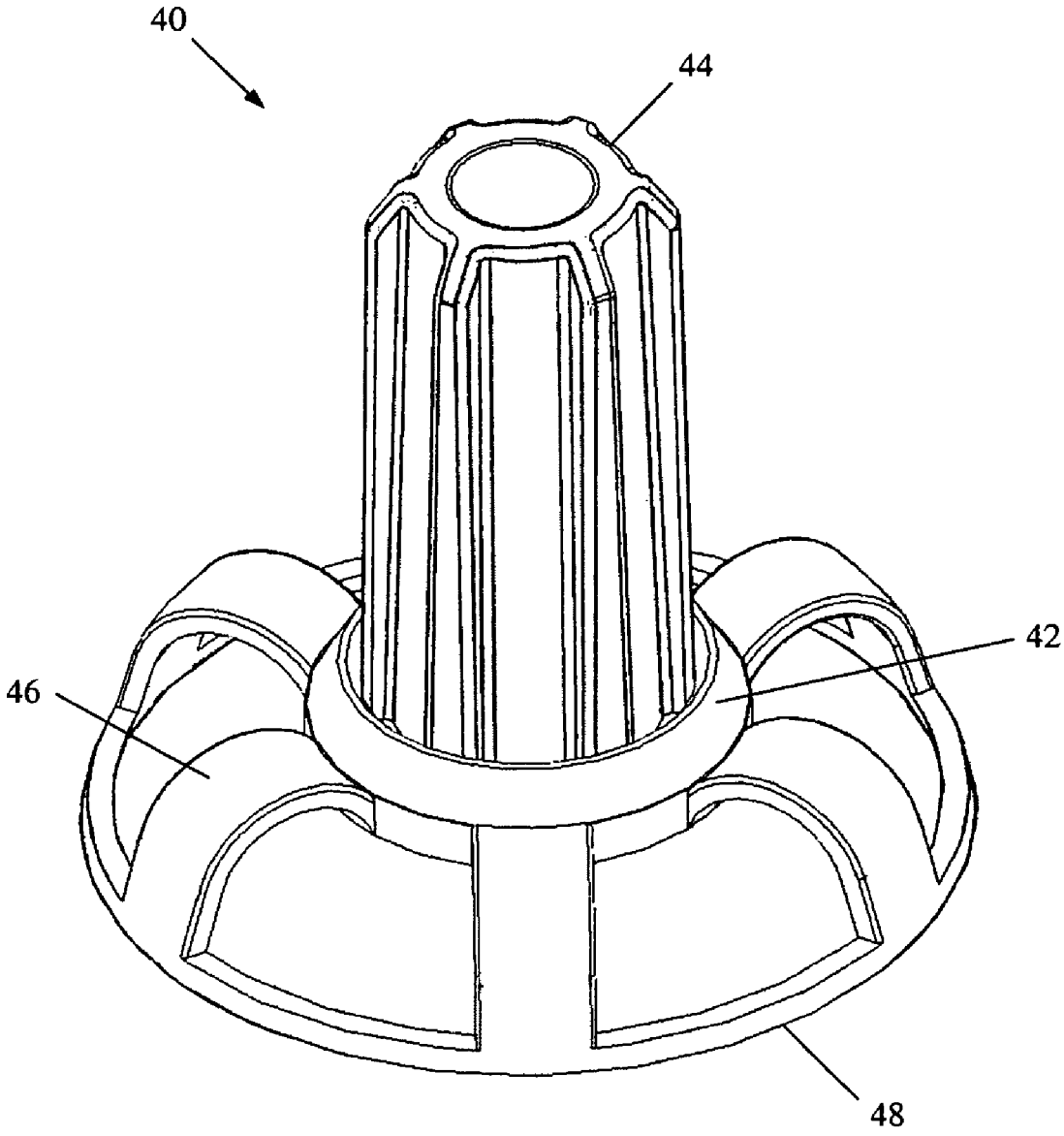
FIG. 4 is a perspective view of a valve member in one embodiment of the present invention.

The valve conduit 30 is also adapted to be retained within an opening in a container with a pressurizing agent that acts as a propellant for dispensing a liquid product. In one embodiment of the present invention, the valve conduit 30 is specifically adapted to be inserted through and retained in an opening 52 in a cup 50 that is secured to an aerosol can. As shown in FIG. 2, the moveable valve member 40 may be inserted into and retained within the valve conduit 30, and the valve conduit 30 may be inserted into and retained within an opening in a cup 50 that may be secured to an aerosol can. FIG. 3 shows a cup 50 secured to the top of a typical aerosol can 54 that may be commonly used in the industry. The valve conduit 30 comprises a retaining member 38 that is configured to secure the valve conduit 30 to an opening 52 in a cup 50 as shown in FIG. 1. It should be noted that the valve of the present invention may also be configured to be retained within other types of openings as well. The valve conduit 30 further comprises an annular seal member 39 that provides a seal against the opening in the container when the valve conduit is secured within the opening of the cup by the retaining member. The valve assembly accordingly provides for reliable valve operation without requiring the additional parts of a biasing spring or a sealing o-ring. Furthermore, since the valve conduit 30 and valve member 40 may be molded of a plastic material, to obtain both a cost effective and a corrosion resistant assembly. Such a valve having a valve conduit and movable valve member in accordance with the principles of the present invention comprises a minimum of moving parts that reduces cost, corrosion and manufacturing concerns.

The advantages of the above described embodiment and improvements should be readily apparent to one skilled in the art, as to enabling a simple valve assembly for use in aerosol containers. Additional design considerations may be incorporated without departing from the spirit and scope of the invention. Accordingly, it is not intended that the invention be limited by the particular embodiment or form described above, but by the appended claims.

What is claimed is:

1. A valve assembly for a container comprising:

a valve conduit having an inlet including a retaining means therein, an outlet and a tapered valve seat in the flow path between the inlet and the outlet;

a valve member received within the valve conduit, the valve member having a resilient spring portion that is retained in a compressed manner by the valve conduit's retaining means for providing a resilient mounting of a valve member within the valve conduit, which permits relative movement of a tapered valve element of the valve member relative to the valve conduit, the tapered valve element being movable to concentrically align with and sealingly engage the tapered valve seat, wherein the valve member includes a stem projecting through and spaced apart from the outlet of the valve conduit; and wherein the valve conduit is adapted to be retained within an opening in the container.

2. The valve assembly of claim 1, wherein the spring portion of the valve member comprises one or more integrally formed springs extending radially from the valve member, the one or more springs being retained with the valve conduit in such a manner that the valve element is biased against the valve seat.

3. The valve assembly of claim 2, wherein the retaining member of the valve conduit comprises a retaining means for retaining the one or more integrally formed springs of the valve member in a compressed manner within the valve conduit such that the valve element is biased against the valve seat by the one or more springs.

4. The valve assembly of claim 3, wherein displacing the stem of the valve member compresses the one or more springs to move the valve element away from the valve seat to allow flow through the valve outlet.

5. The valve assembly of claim 1, wherein the valve element comprises a tapered surface that sealingly engages the valve seat.

6. The valve assembly of claim 5, wherein the valve seat comprises an opening having a tapered surface.

7. The valve assembly of claim 6, wherein during the movement of the valve element, the valve element's tapered surface engages and concentrically aligns with the tapered surface on the valve seat to establish an effective seal against the valve seat.

8. The valve assembly of claim 7, wherein the valve conduit comprises a retaining member configured to secure the valve conduit within an opening in a container.

9. The valve assembly of claim 8, wherein the valve conduit comprises an annular seal member that provides a seal against the opening in the container when the valve conduit is secured within the opening of the container by the retaining member.

10. The valve assembly of claim 9, wherein the annular seal member is compressed within the opening in the container to provide a seal against the opening.

11. A valve assembly for an aerosol can comprising:

a valve conduit having an inlet including a retaining means therein, an outlet and a tapered valve seat in the flow path between the inlet and the outlet;

a valve member received within the valve conduit, the valve member having a resilient spring portion that is retained in a compressed manner by the valve conduit's retaining means for providing a resilient mounting of a valve member within the valve conduit, which permits relative movement of a tapered sealing surface on the valve member relative to the valve conduit, the tapered sealing surface being biased towards and movable to concentrically align with and to sealingly engage the tapered valve seat, and the valve member having a stem projecting through and spaced apart from the outlet of the valve conduit that may be displaced to move the tapered sealing surface away from the valve seat to allow flow through the valve outlet.

12. The valve assembly of claim 11, wherein the valve conduit is adapted to be retained within an opening in a cup that is secured to the aerosol can.

13. The valve assembly of claim 11, wherein the spring portion of the valve member comprises one or more integrally formed springs extending radially from the valve member, the one or more springs being retained with the valve conduit in such a manner that the springs resiliently bias the tapered sealing surface against the tapered valve seat.

14. The valve assembly of claim 13, wherein the retaining means of the valve conduit comprises a retaining means for retaining the one or more springs of the valve member within the valve conduit in a manner such that the tapered sealing surface is biased against the valve seat by the one or more springs.

15. The valve assembly of claim 14, wherein the retaining means comprises a tapered annular ring in the inlet of the valve conduit.

16. The valve assembly of claim 11, wherein displacing the stem of the valve member compresses the one or more springs to move the tapered sealing surface away from the valve seat to allow flow through the valve outlet.

17. The valve assembly of claim 11, wherein during the movement of the valve member's tapered sealing surface, the tapered sealing surface engages and concentrically aligns with the tapered valve seat surface to establish an effective seal against the valve seat.

18. The valve assembly of claim 17, wherein the tapered valve surface comprises a continuous, smooth surface.

19. The valve assembly of claim 18, wherein the smooth surface is free of any mold parting lines.

20. The valve assembly of claim 18, wherein the tapered valve seat comprises a continuous smooth surface free of any mold parting lines.

21. A valve assembly for an aerosol can comprising:

a valve conduit having an inlet including a retaining means therein, an outlet and a tapered valve seat in the flow path between the inlet and the outlet;

a valve member mounted within the valve conduit, the valve member having a resilient spring portion that is retained in a compressed manner by the valve conduit's retaining means for providing a resilient mounting of the valve member in a manner that permits relative movement of a tapered sealing surface on the valve member relative to the valve conduit, the valve member having a stem projecting through and spaced apart from the outlet of the valve conduit and a resilient spring portion comprising one or more integrally formed springs extending radially from the valve member that are retained within the valve conduit in a manner such that the tapered sealing surface of the valve member is biased towards and movable to concentrically align with and to sealingly engage the tapered valve seat, wherein the valve stem may be displaced to move the tapered sealing surface away from the valve seat to allow flow through the valve outlet; and wherein during the movement of the valve member the tapered sealing surface is configured to engage and concentrically align with the tapered valve seat to establish an effective seal against the valve seat.

22. The valve assembly of claim 21, wherein the valve conduit is adapted to be retained within an opening in a cup that is secured to the aerosol can.

23. The valve assembly of claim 22, wherein the valve conduit comprises a retaining member configured to secure the valve conduit within an opening in a container.

24. The valve assembly of claim 21, wherein the valve conduit comprises a retaining means for retaining the one or more springs of the valve member within the valve conduit.

25. The valve assembly of claim 24, wherein the retaining means comprises a tapered annular ring in the inlet of the valve conduit.

26. The valve assembly of claim 21, wherein the tapered sealing surface comprises a continuous, smooth surface.

27. The valve assembly of claim 26, wherein the smooth surface is free of any mold parting lines.

28. The valve assembly of claim 27, wherein the tapered valve seat comprises a continuous smooth surface free of any mold parting lines.

29. An aerosol can in connection with a valve assembly comprising:

an aerosol can;

a cup secured to the aerosol can having an opening therein;

a valve conduit having an inlet including a retaining means therein, an outlet and a tapered valve seat in the flow path between the inlet and the outlet, the valve conduit being adapted to be secured within an opening in the cup secured to the aerosol can;

a valve member mounted within the valve conduit, the valve member having a resilient spring portion that is retained in a compressed manner by the valve conduit's retaining means for providing a resilient mounting of the valve member in a manner that permits relative movement of a tapered sealing surface on the valve member relative to the valve conduit, the valve member having a stem projecting through and spaced apart from the outlet of the valve conduit and a resilient spring portion comprising one or more integrally formed springs extending radially from the valve member that are retained within the valve conduit in a manner such that the tapered sealing surface is biased towards and movable to concentrically align with and to sealingly engage the tapered valve seat, wherein the valve stem may be displaced against the spring bias to move the tapered valve surface away from its sealed position to allow flow through the valve outlet; and wherein during the movement of the valve member the tapered sealing surface is configured to engage and concentrically align with the tapered valve seat to form an effective seal.

30. The aerosol can of claim 29, wherein the valve conduit comprises a retaining member configured to secure the valve conduit in sealing engagement within the opening in the cup.

31. The aerosol can of claim 30, wherein the valve conduit comprises a retaining means for retaining the one or more springs of the valve member within the valve conduit.

32. The aerosol can of claim 31, wherein the retaining means comprises a tapered annular ring in the inlet of the valve conduit.

33. The valve assembly of claim 29, wherein the tapered sealing surface comprises a continuous, smooth surface that is free of any mold parting lines.

34. The valve assembly of claim 33, wherein the tapered valve seat comprises a continuous, smooth surface that is free of any mold parting lines.

* * * * *